US005230562A

United States Patent [19]

Nishimi et al.

[11] Patent Number: 5,230,562

[45] Date of Patent: Jul. 27, 1993

[54] VISCOUS LIQUID PROCESSOR

[75] Inventors: Haruyuki Nishimi, Toyo; Mamoru Mishima, Niihama; Shoji Morinaga, Toyo, all of Japan

[73] Assignee: Sumitomo Heavy Industries, Ltd., Tokyo, Japan

[21] Appl. No.: 900,781

[22] Filed: Jun. 22, 1992

Related U.S. Application Data

[63] Continuation of Ser. No. 605,313, Oct. 30, 1990.

[30] Foreign Application Priority Data

Nov. 2, 1989 [JP] Japan ..... 1-287150

[51] Int. Cl.[5] ..... B01F 7/10

[52] U.S. Cl. ..... 366/298; 366/299; 366/300; 366/301; 366/309; 366/262

[58] Field of Search ..... 366/297, 298, 300, 301, 366/309, 311, 312, 313, 326, 327, 97, 325, 328, 329, 330; 405/200, 204, 202, 208, 209

[56] References Cited

U.S. PATENT DOCUMENTS

| | | | |
|---|---|---|---|
| 254,042 | 2/1882 | Pfleiderer | 366/97 |
| 2,631,016 | 3/1953 | Laubarede | 366/297 |
| 3,346,242 | 10/1967 | List . | |
| 3,622,126 | 11/1969 | Eberle | 366/327 |
| 4,093,419 | 6/1978 | Tauber et al. | 366/300 |
| 4,474,475 | 10/1984 | Moriyama | 366/298 |
| 4,493,557 | 1/1985 | Nayak et al. | 366/297 |
| 4,950,081 | 8/1990 | List | 366/313 |

FOREIGN PATENT DOCUMENTS

| | | |
|---|---|---|
| 0144092 | 6/1985 | European Pat. Off. . |
| 0329092 | 8/1989 | European Pat. Off. . |
| 2012294 | 10/1970 | Fed. Rep. of Germany . |
| WO 88/04198 | 6/1988 | Fed. Rep. of Germany . |
| 2090808 | 1/1972 | France . |
| 2344602 | 10/1977 | France . |
| 47-27179 | 7/1972 | Japan . |
| 49-73759 | 7/1974 | Japan . |
| 51-45559 | 11/1976 | Japan . |
| 54-5805 | 3/1979 | Japan . |
| 61-59173 | 12/1986 | Japan . |
| 62-50179 | 10/1987 | Japan . |

*Primary Examiner*—Harvey C. Hornsby
*Assistant Examiner*—Reginald L. Alexander
*Attorney, Agent, or Firm*—Nikaido, Marmelstein, Murray & Oram

[57] ABSTRACT

A viscous liquid processor includes a low-speed shaft and a high-speed shaft extending in parallel within a casing, and a plurality of agitator blades fixed on each of the shafts and spaced along its axial direction so that the blades on one shaft enter the spaces between the blades on the other shaft. Each of the agitator blades is generally formed in a thick disk-like configuration having a plurality of thick blade members, such a thick blade member having a parallelogrammic cross section. With this simple arrangement, delivery and shearing of highly viscous liquid can be performed to improve the agitation and stirring effects.

5 Claims, 9 Drawing Sheets

VISCOUS LIQUID PROCESSOR

This application is a continuation of application Ser. No. 605,313 filed Oct. 30, 1990.

BACKGROUND OF THE INVENTION

1. Industrial Field of the Invention

The present invention relates to a viscous liquid processor and, more particularly, to a viscous liquid processor which includes two horizontal shafts.

2. Description of the Prior Art

In general, viscous liquid processors of this kind are roughly classified into a continuous type and a batch type. A horizontal viscous liquid processor of the continuous type is structured in such a manner that a material to be processed is supplied from an inlet provided on one longitudinal end of a casing, moves toward an outlet provided on the other longitudinal end (making so-called piston flows) while the degree of reaction or the like is increased, and is discharged from the outlet after a desired process has been completed (see Japanese Patent Examined Publication No. 47-27179, Japanese Utility Model Examined Publication Nos. 51-45559 and 54-5805, Japanese Patent Examined Publication Nos. 61-59173 and 62-50179, and the like). Consequently, the viscous liquid processor of this continuous type has a characteristic that the degree of reaction varies in accordance with the position of the flowing material in the course from the inlet to the outlet.

On the other hand, a horizontal viscous liquid processor of the batch type is structured in such a manner that one dose of a material to be processed, which has been calculated previously, is fed into a casing, and discharged to the outside after a desired process has been completed, another dose of the material being fed into the casing anew (see Japanese Patent Unexamined Publication No. 49-73759 and the like). Therefore, the viscous liquid processor of this batch type has a characteristic that the degree of reaction varies in accordance with the length of processing time, so that it will be preferred that the material at any position in the casing can be simultaneously reacted uniformly in a certain length of processing time.

Whether it is of the continuous type or of the batch type, a viscous liquid processor requires such functions as uniform shearing and agitation of viscous liquid, circulation or delivery of the liquid in one direction, cooperative scraping of the liquid by agitator blades (self-cleaning), replacement of the liquid surface, and the like. However, there has conventionally been no viscous liquid processor in which these functions, especially the shearing/agitation function and the liquid delivering function can be simultaneously effected by means of disk-like agitator blades having a structure as simple as possible.

SUMMARY OF THE INVENTION

The present invention has been accomplished to solve the problems of the conventional techniques. It can be summarized as follows: a viscous liquid processor comprising a horizontal casing which includes side walls on both longitudinal ends thereof, two shafts extending in parallel within the casing along its longitudinal direction and rotatably supported between the side walls, and a plurality of agitator blades fixed on each of the shafts and spaced along its longitudinal direction so that the blades on one shaft enter the spaces between the blades on the other shaft, the casing having a bottom portion corresponding to the tracks of the outer peripheral ends of the agitator blades, wherein each of the agitator blades is generally formed in a thick disk-like configuration having a plurality of thick blade members, such a thick blade member having a parallelogrammic cross section.

DESCRIPTION OF THE PREFERRED EMBODIMENTS

Figure 1:
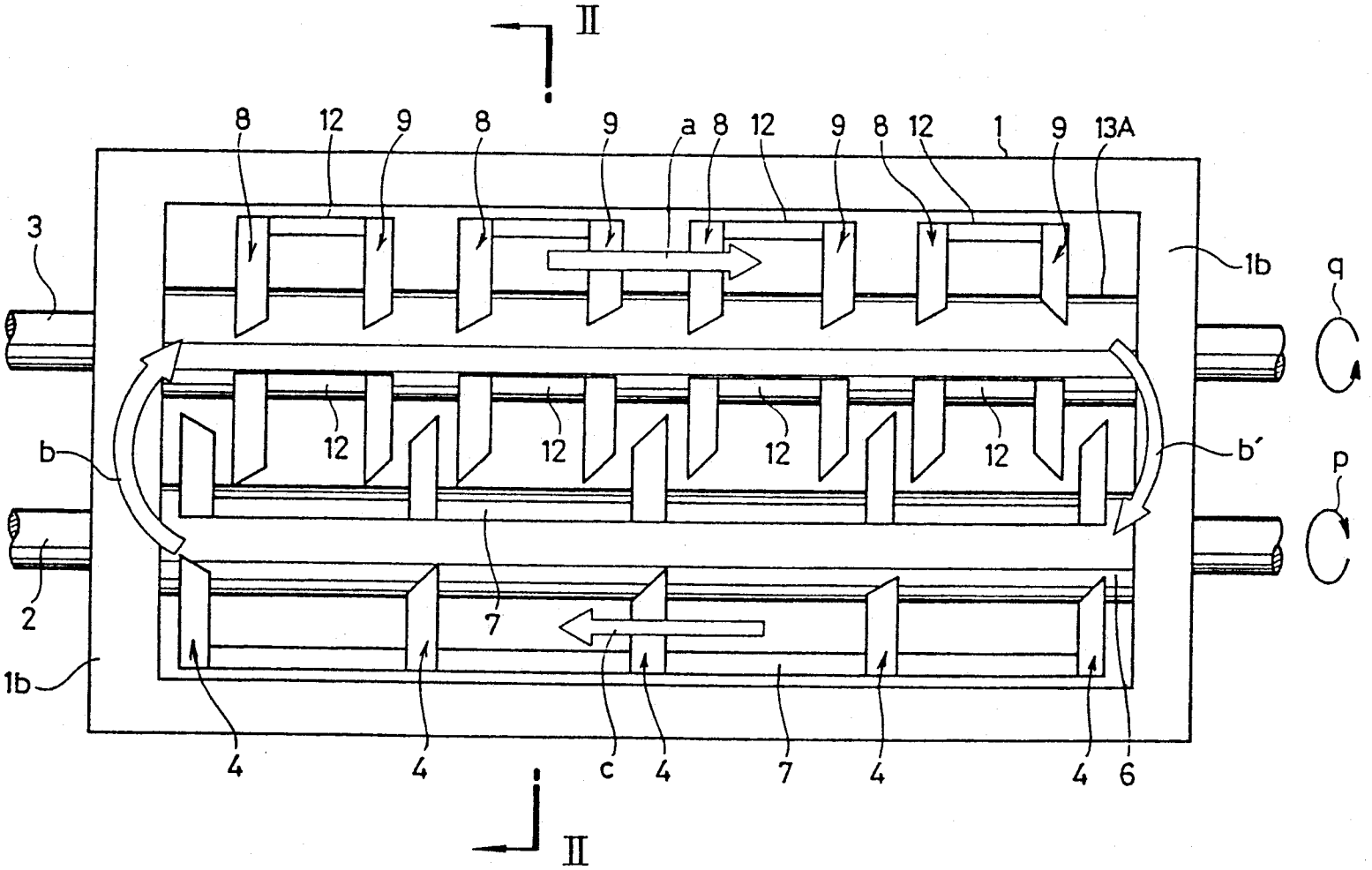
FIG. 1 is a plan view showing a first embodiment of the present invention.

The structure and operation of a batch-type viscous liquid processor according to a first embodiment of the present invention will now be described in detail with reference to FIGS. 1 to 9.

This embodiment is a batch-type viscous liquid processor including two horizontal shafts for agitating viscous liquid of high-molecular polymer or the like for the purpose of a process such as polycondensation, bulk polymerization, solution polymerization, gas-liquid reaction and monomer degradation.

In these drawings, reference numeral 1 denotes a casing which has a bottom portion corresponding to the tracks of outer peripheral ends of agitator blades which will be explained later. At the center of this bottom portion, a rib 1*a* is formed along the longitudinal direction of the casing 1. A low-speed shaft 2 and a high-speed shaft 3 extending in parallel are provided horizontally between and through side walls 1*b* on both longitudinal ends of the casing 1, and the shafts 2 and 3 are rotated in opposite directions to each other, as indicated by arrows p and q, to agitate the liquid to be processed between these shafts from the upper side. The shafts 2, 3 are provided with the agitator blades. It should be noted that the casing 1 can be sealed with a lid (not shown) in order to perform a reaction process in a vacuum condition or a pressurized condition of reaction gas.

Figure 4:
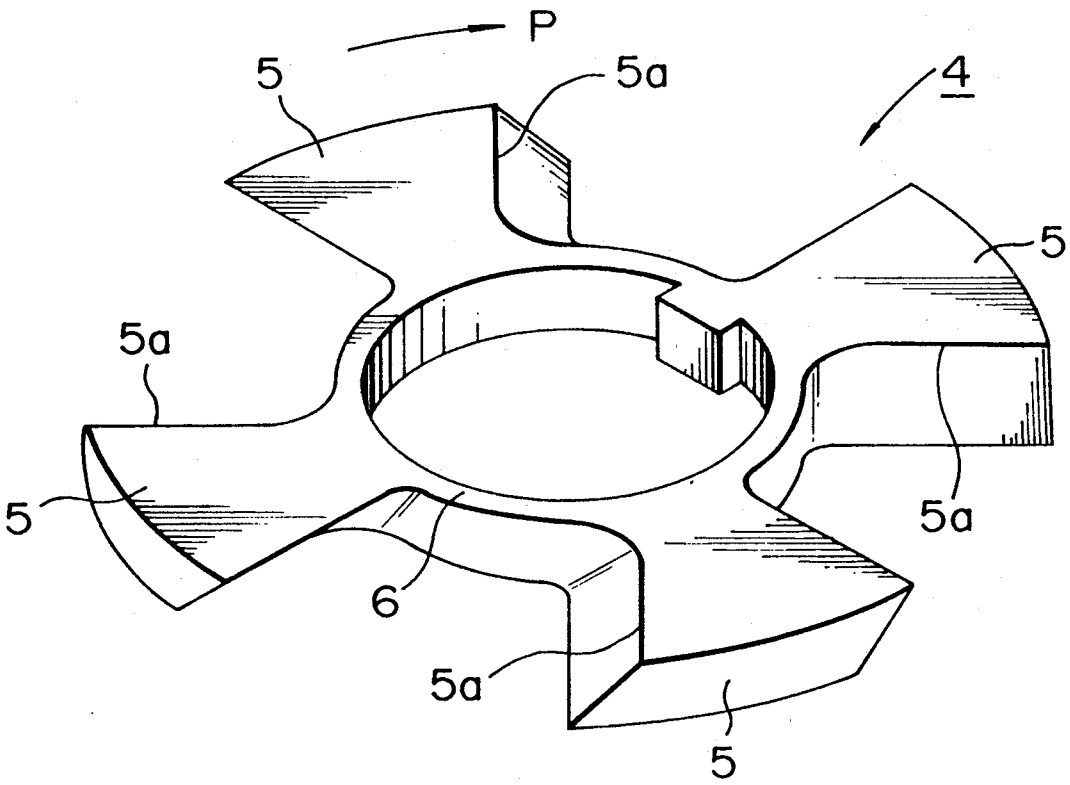
FIG. 4 is a perspective view of a low-speed agitator blade of the first embodiment.
Figure 7:
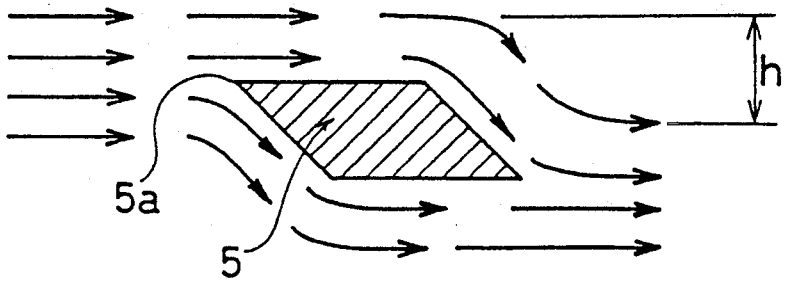
FIGS. 7 to 9 are views illustrative of functions of blade members of the agitator blades shown in FIGS. 4 to 6, respectively.
Figure 8:
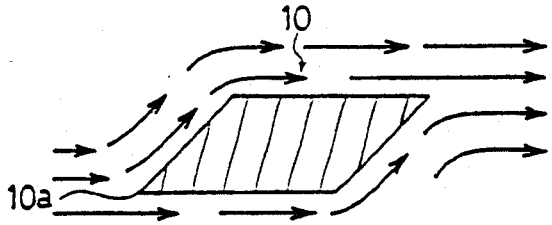
Figure 9:
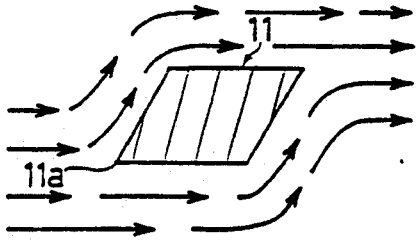
Figure 10:
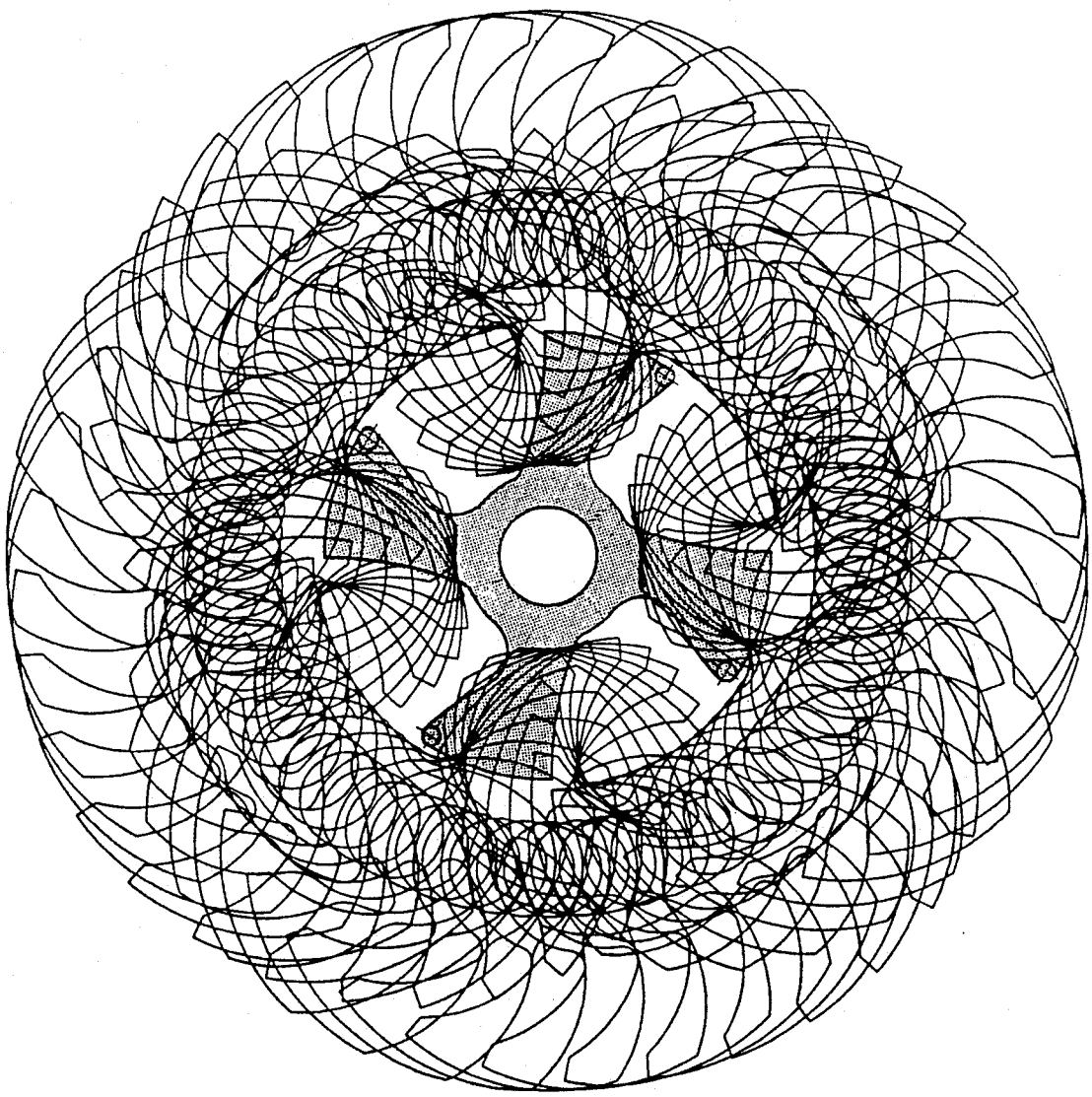
FIG. 10 is a view of the tracks of rotations of the high-speed agitator blades relative to the low-speed agitator blade when a low-speed shaft is supposed to be stationarily fixed.

A low-speed agitator blade 4 is of a shape as shown in FIG. 4. An odd-number (e.g., five) of such blades at different phases are securely fixed on the low-speed shaft 2 so as to form a tandem pattern. Each of the low-speed agitator blades 4 is constituted of a plurality of (e.g., four) radially sectorial blade members 5 which are made by machining the intermediate portions cut away from a thick disk at the same intervals. A jacket through which a thermal medium flows is formed on the inside of each of the sectorial blade members 5 if necessary. As illustrated in FIG. 7, the cross section of the sectorial blade member 5 is formed to be a parallelogram so that the leading end of the blade member as viewed in a direction of rotation of the low-speed agitator blade 4 defines an acute angle, and that the opposite end of the same end surface as the leading end defines an obtuse angle. The acute-angled end serves as a shearing edge 5*a*, and its inclined surface has a liquid delivering function to an extent of a thickness (h) thereof. The low-speed agitator blades 4 are each securely fixed on the low-speed shaft 2 through a boss 6.

Further, one end of a scraper rod 7 is fastened on the trailing outer peripheral end of each sectorial blade member 5 of the low-speed agitator blade 4 as viewed in the direction of rotation, and the other end of the scraper rod 7 is fastened on the leading outer peripheral end of each sectorial blade member 5 of the adjacent agitator blade 4. Thus, such scraper rods 7 are located in a continuous spiral pattern.

Figure 5:
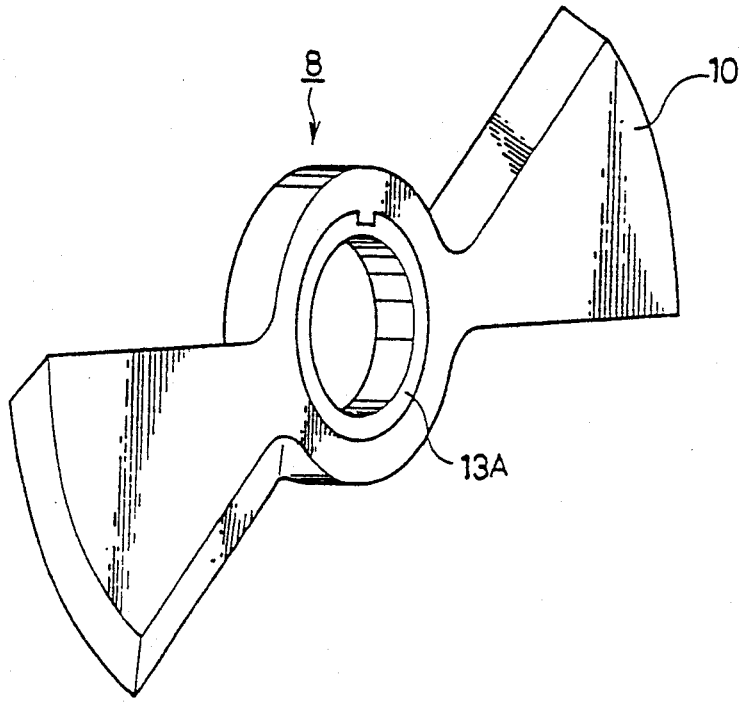
FIGS. 5 and 6 are perspective views showing two kinds of high-speed agitator blades of the first embodiment.
Figure 6:
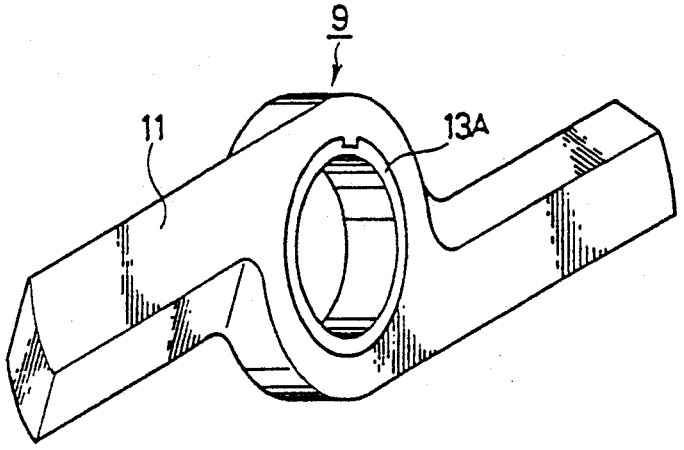

On the other hand, an even-number (e.g., eight) of high-speed agitator blades 8, 9 are securely fixed on the high-speed shaft 3 so as to form a tandem pattern. As shown in FIGS. 5 and 6, each of the high-speed agitator blades 8 is constituted of a plurality of (e.g., two) wide sectorial blade members 10 (FIG. 5), which are substantially the same as the above-mentioned sectorial blade members 5, formed by machining the intermediate portions cut away from a thick disk, and each of the high-speed agitator blades 9 is constituted a plurality of (e.g., two) small blade members 11 (FIG. 6) having a substantially rectangular shape which are formed by further machining the sectorial blade members. The agitator blades 8, 9 are each securely fixed on the high-speed shaft 3 through a boss 13*a* in such a manner that the blade members 10, 11 are located at phases which are deviated from each other at an angle of 90° C. A jacket through which a thermal medium flows is formed on the inside of each of the blade members 10, 11 if necessary. As illustrated in each of FIGS. 8 and 9, the cross section of the blade member 10, 11 is formed to be a parallelogram so that the leading end of the blade member as viewed in a direction of rotation of the high-speed agitator blade 8, 9 defines an acute angle, and that the opposite end of the same end surface as the leading end defines an obtuse angle in the same manner as the above-described sectorial blade member 5 for low-speed agitation. Side surfaces of these blade members 10, 11 are inclined in a direction reverse to a direction of inclination of the inclined surfaces of the sectorial blade member 5 of the low-speed agitator blade 4.

Further, one end of a scraper rod 12 is fastened on the trailing outer peripheral end of each small blade member 11 of the high-speed agitator blade 9 as viewed in the direction of rotation, and the other end of the scraper rod 12 is fastened on the trailing outer peripheral end of each sectorial blade member 10 of the adjacent agitator blade 8 as viewed in the direction of rotation, while no scraper rod is provided between a sectorial blade member 10 and a small blade member 11 which are adjacent to each other with the above-mentioned low-speed agitator blade 4 interposed therebetween. Thus, such scraper rods 12 are located in a discontinuous spiral pattern whose lead has the same direction as the lead of the spiral pattern formed by the scraper rods 7 of the low-speed shaft 2. The sectorial blade members 5 of the low-speed agitator blades 4 are located between such unconnected blade members 10 and 11. On the other hand, gate-like agitators formed of the blade members 10, 11 of the high-speed agitator blades 8, 9 and the scraper rods 12 are relatively rotatably provided between the sectorial blade members 5 of two adjacent low-speed agitator blades 4. The condition of these blade members which are rotated across each other when they are viewed from the side wall 1*b* is illustrated in an area A of FIG. 2.

Next, the operation of this embodiment will be explained. Highly viscous liquid to be processed is fed into the casing 1 until it substantially reaches a level of the shaft center. When a motor (not shown) is activated, rotation of the motor is transmitted through appropriate reduction gears (not shown) to the low-speed shaft 2 and the high-speed shaft 3 so that these shafts 2 and 3 are rotated at a speed ratio 1:2. It should be noted that the numbers of the blade members for the low-speed shaft 2 and the high-speed shaft 3 will not be restricted to those of this embodiment. It can be arranged that each agitator blade of the high-speed shaft 3 has two blade members or more, and that each agitator blade of the low-speed shaft 2 has an integer times as many blade members as the agitator blade of the high-speed shaft 3, with the rotational ratio being set to be an inverse number of the number of the blade members.

Figure 2:
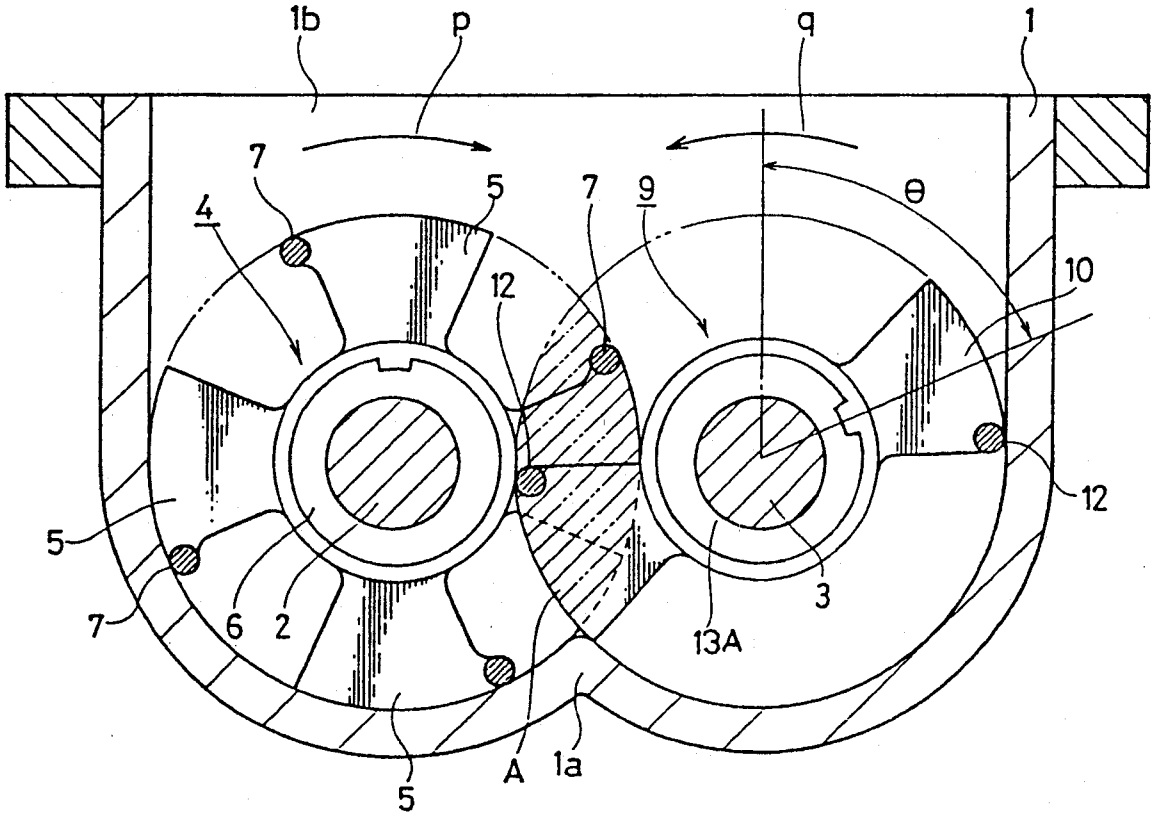
FIG. 2 is a vertical cross-sectional view of the first embodiment taken along a line II—II of FIG. 1.
Figure 3:
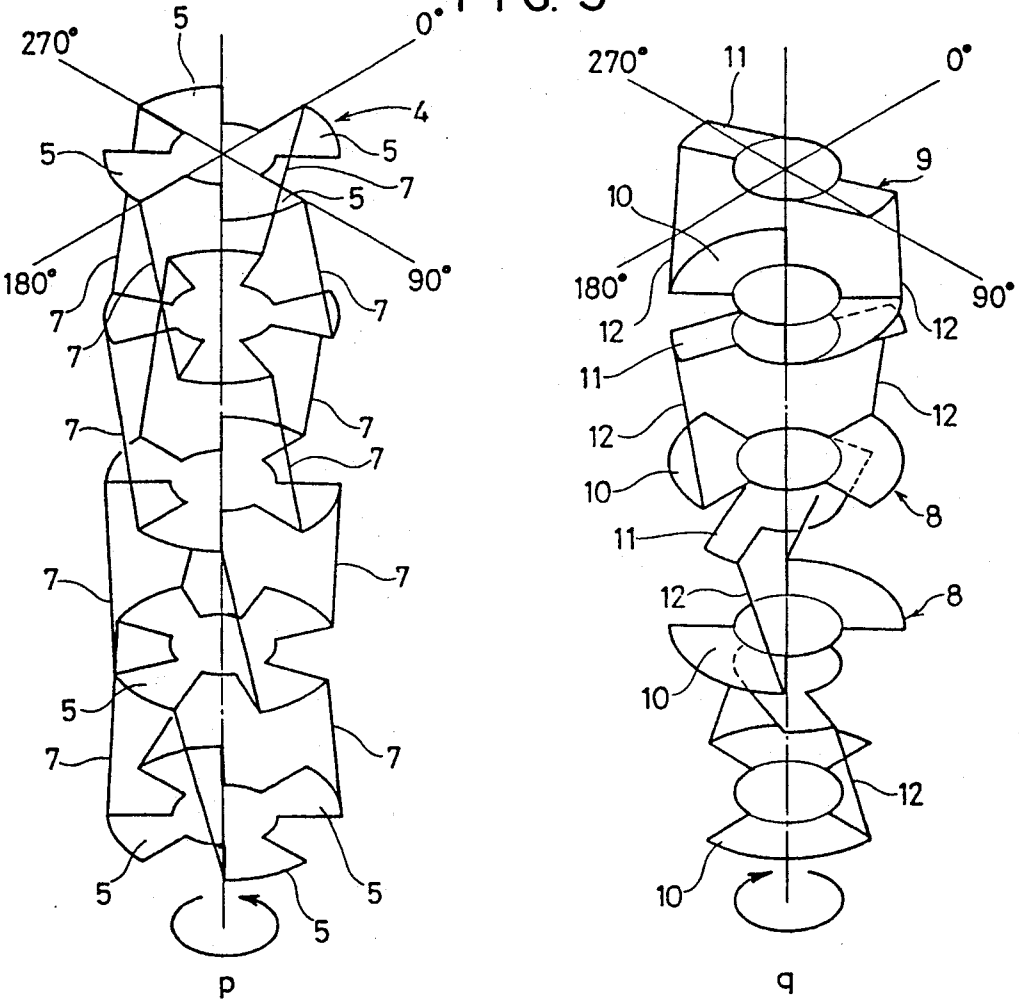
FIG. 3 is schematic views showing agitator blades of the first embodiment.

Then, as illustrated in the area A of FIG. 2, the sectorial blade members 5 of the low-speed agitator blades 4 and the blade members 10, 11 of the high-speed agitator blades 8, 9 together with the scraper rods 7, 12 are relatively rotated, with the blade members on one shaft entering the spaces defined by the blade members on the other shaft in a region between the shafts. As a result, when the shearing edges 5*a*, 10*a*, 11*a* of the sectorial blade members 5 of the low-speed agitator blades 4 and the sectorial blade members 10 and the small blade members 11 of the high-speed agitator blades 8, 9 are rotated at different speeds, the viscous liquid is strongly sheared and agitated to be pressed against the rib 1*a* of the casing 1, i.e., the viscous liquid is agitated and stirred while constantly replacing a portion of the liquid on the free surface with another portion so as to be supplied toward both side walls of the casing 1 which are in parallel to the rotating shafts 2, 3. In this case, the viscous liquid is circulated within the casing 1 in a single direction indicated by arrows a, b', c, b of FIG. 1 under the influence of the liquid delivering functions of the respective inclined surfaces of the blade members 5, 10, 11 in directions indicasted by the arrows a, c. Besides, since portions of the viscous liquid which are adhered on the inner peripheral surfaces of the casing 1 are affected by the liquid delivering function while they are scraped for self-cleaning by means of the scraper rods 7, 12 which are located in the spiral patterns having the identical lead, the above-described circulation of the liquid is promoted. Further, when these scraper rods 7, 12 leave the viscous liquid and raise some of the liquid, hanging thin films of the liquid are formed, and consequently, the gas-liquid contact face can be enlarged to improve the efficiency of deaeration.

Experiments of the first embodiment were conducted as follows:

EXAMPLE

Diameter of a disk for an agitator blade: 134 mm
Size of a casing: 236 mmW×168 mmH×612 mmL
Liquid quantity: 5.6 l Reaction temperature: 330° C. max Viscous liquid: A polyester resin in an intermediate state to be further polymerized and collected as a highly polymerized resin.

According to results of the test, desired effects such as agitation/stirring efficiency, self-cleaning effciency and surface replacement efficiency were obtained from the present invention.

A second embodiment in which the present invention is applied to a continuous-type viscous liquid processor will now be described.

Figure 11:
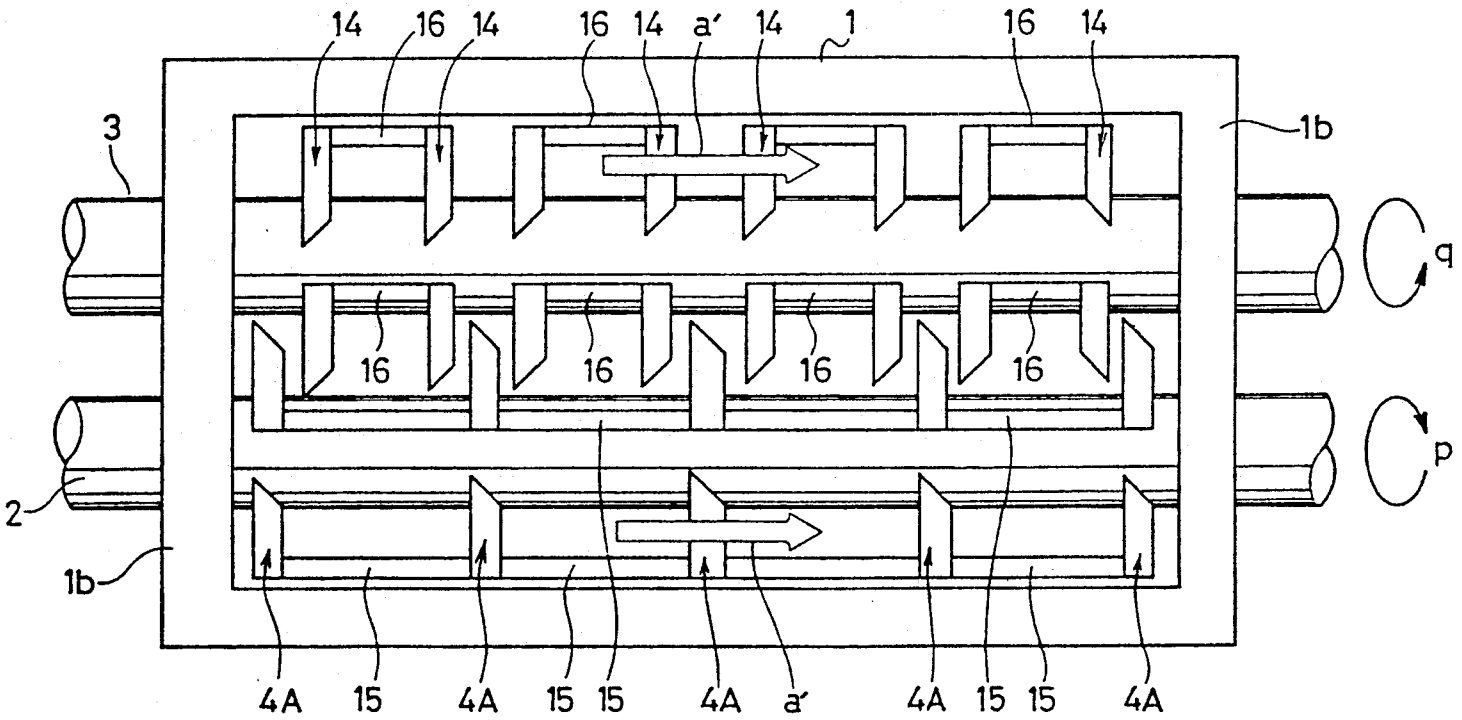
FIG. 11 is a plan view showing a second embodiment of the present invention.
Figure 12:
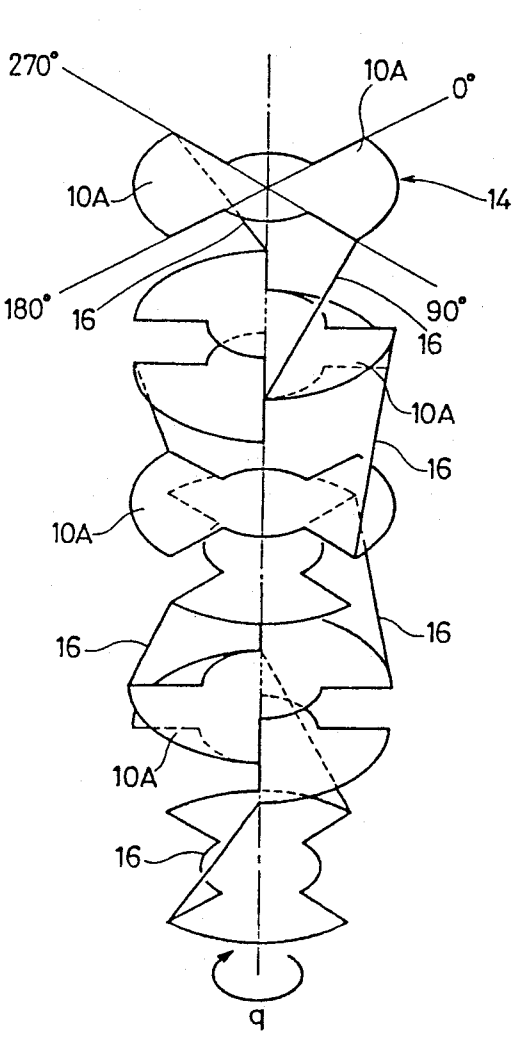
FIG. 12 is schematic views showing agitator blades of the second embodiment.
Figure 12:
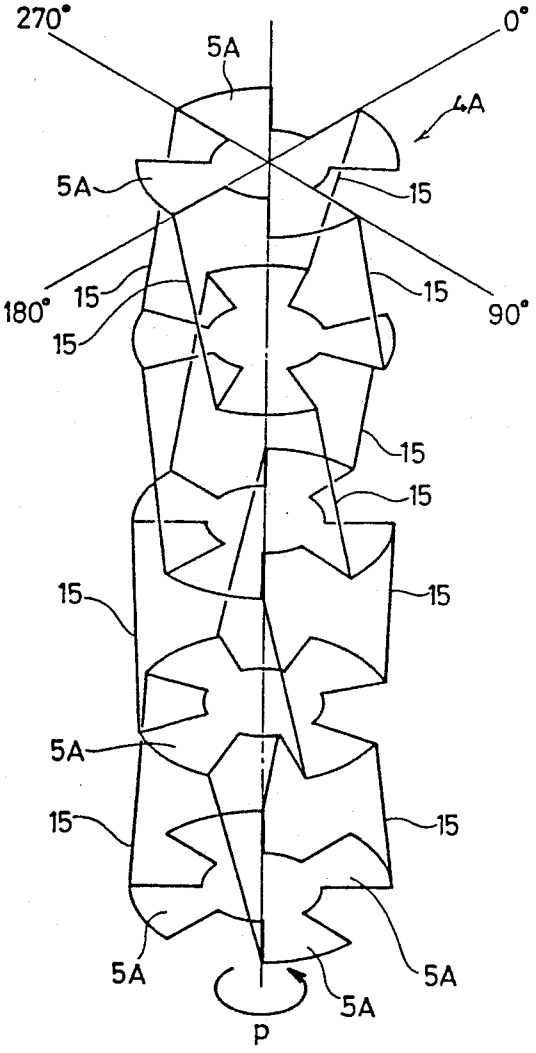

FIGS. 11 and 12 illustrate the second embodiment, and the same component parts as those of the first embodiment are denoted by the same reference numerals in these drawings, explanation of such component parts being omitted except for the differences.

In this embodiment, an inlet is formed on one of the side walls 1*b* of the casing 1 (left in FIG. 11), and an outlet is formed on the other (right in FIG. 11), so that highly viscous liquid supplied from the inlet is processed while it is continuously delivered in a direction indicated by arrows a' in the drawing, and is discharged from the outlet.

The low-speed shaft 2 is provided with low-speed agitator blades 4A each including sectorial blade members 5A which are substantially the same as the low-speed agitator blades 4 of the first embodiment described above, and the high-speed shaft 3 is provided with high-speed agitator blades 14 in a tandem pattern each including sectorial blade members 10A similar to the sectorial blade members 10 of the first embodiment shown in FIG. 5, with the inclined surfaces of the sectorial blade members 5A of the low-speed agitator blades 4A being inclined in the same direction as the inclined surfaces of the sectorial blade members 10A of the high-speed agitator blades 14. Further, scraper rods 15 are fastened on the outer peripheral ends of the sectorial blade members 5A of the low-speed agitator blades 4A so as to form a continuous spiral pattern in the same manner as the first embodiment. On the other hand, each of the high-speed agitator blades 14 is securely fixed on the high-speed shaft 3 at a phase deviated from a phase of the adjacent agitator blade at an angle of 90° C., and one end of a scraper rod 16 is fastened on the leading outer peripheral end of each sectorial blade member 10A of the high-speed agitator blade 14 as viewed in a direction of rotation, while the other end of the scraper rod 16 is fastened on the leading outer peripheral end of each sectorial blade member 10A of the adjacent agitator blade 14, such scraper rods 12 being located in a discontinuous spiral pattern. With this arrangement, the viscous liquid supplied from the inlet will be continuously agitated and stirred, traveling in the direction of the arrows a' toward the outlet.

In the embodiments described heretofore, each low-speed agitator blade has four sectorial blade members 5, 5A, and each high-speed agitator blade has two blade members 10, 11, 10A. However, the invention will not exclude other combinations of the numbers of these blade members if they meet a ratio 2:1. For example, each low-speed agitataor blade may have six blade members, and each high-speed agitator blade may have three blade members.

Besides, the low-speed shaft 2 and the high-speed shaft 3 extending in parallel are rotated in such a manner that the agitator blades on both shafts will agitate the liquid between these shafts from the upper side in the above embodiments. However, the low-speed shaft 2 and the high-speed shaft 3 may be rotated the other way round to cause the agitator blades to agitate the liquid between these shafts from the lower side.

According to the present invention, since the agitator blades on both shafts are rotated to agitate the viscous liquid between the two shafts from the upper or lower side, the viscous liquid between the shafts is pressed against the casing. Each of the inclined surfaces of the sectorial blade members made of machined disks serves to deliver the liquid to an extent of the thickness thereof, and the opposite inclined surface draws the liquid due to the negative pressure generated thereon. As a result, agitation and stirring of the viscous liquid can be performed with such a simple arrangement, and stirring of the viscous liquid can be further promoted by shearing the liquid by means of the leading edges of the sectorial blade members each of which defines an acute angle.

Moreover, each of the agitator blades is thick, so that a jacket for thermal treatment can be formed within the agitator blade.

Furthermore, because each of the blade members has a cross section of a parallelogram, the surfaces of the blade member are smooth and flat, thereby preventing the viscous liquid from adhering to the blade surfaces, while enabling effective scraping by the scraper rods.

What is claimed is:

1. A viscous liquid processor comprising:

a horizontal casing which includes side walls on both longitudinal ends thereof;

two shafts extending in parallel within said casing along a longitudinal direction and rotatably supported between said side walls; and a plurality of agitator blades fixed on each of said shafts and spaced along said longitudinal direction so that the blades on one shaft enter spaces between the blades on the other shaft, wherein each of said agitator blades is generally formed in a thick disk configuration having a plurality of thick blades members, each thick blade member having a parallelogrammic cross section, one of said shafts provided with two different types of agitator blades alternately disposed therealong, one type of agitator blade having sectorial blade members and another type of agitator blade member having small blade members of a substantially rectangular shape, and said other shaft provided with agitator blades having sectorial blade members, wherein a number of the blade members of each agitator blade fixed on one of said two shafts is two or more, and a number of the blade members of each agitator blade fixed on the other shaft is an integer times as large as the number of the blade members of the agitator blade fixed on said one shaft, and scraper rods which interconnect outer peripheries of said plurality of agitator blades fixed on said two shafts to form a spiral pattern, a direction of a lead of said scraper rods provided on one of said two shafts being a same direction of a lead provided on the other of said two shafts, said casing having a bottom portion corresponding to tracks of outer peripheral ends of said agitator blades.

2. A viscous liquid processor according to claim 1, wherein oblique sides of respective parallelogrammic cross sections of the blade members of the agitator blades fixed on said two shafts are inclined in a same direction.

3. A viscous liquid processor according to claim 1 wherein said scraper rods fixed on one of said two shafts forming a continuous spiral pattern and said scraper rods fixed on said another of said two shafts forming a discontinuous spiral pattern.

4. A viscous liquid processor comprising:

a horizontal casing which includes side walls on both longitudinal ends thereof;

two shafts extending in parallel within said casing along a longitudinal direction and rotatably supported between said side walls; and a plurality of agitator blades fixed on each of said shafts and spaced along said longitudinal direction so that two adjacent blades on one shaft enter each space between two adjacent blades on the other shaft, wherein each of said agitator blades is generally formed in a thick disk configuration having a plurality of thick blade members, each thick blade member having a parallelogrammic cross section, wherein a number of the blade members of each agitator blade fixed on one of said two shafts is two or more, and a number of the blade members of each agitator blade fixed on the other shaft is an integer times as large as the number of the blade members of the agitator blade fixed on said one shaft, and scraper rods which interconnect outer peripheries of said plurality of agitator blades on each of said two shafts to form a spiral pattern, a direction of a lead of said scraper rods provided on one of said two shafts being a same direction of a lead provided on the other of said two shafts, said casing having a bottom portion corresponding to tracks of outer peripheral ends of said agitator blades.

5. A viscous liquid processor according to claim 4 wherein said scraper rods fixed on one of said two shafts forming a continuous spiral pattern and said scraper rods fixed on said another of said two shafts forming a discontinuous spiral pattern.

* * * * *